United States Patent [19]

Kelley

[11] 4,036,160

[45] July 19, 1977

[54] METHOD OF MAKING WEAKENING LINES IN SHEET METAL

[75] Inventor: John Sherburne Kelley, Wenham, Mass.

[73] Assignee: USM Corporation, Boston, Mass.

[21] Appl. No.: 689,642

[22] Filed: May 24, 1976

[51] Int. Cl.[2] ..... B21D 51/44

[52] U.S. Cl. ..... 113/121 C

[58] Field of Search ..... 113/15 R, 15 A, 121 C; 83/6, 7, 8, 9, 18, 19, 20, 21; 72/325, 335; 220/268; 29/DIG. 33

[56] References Cited

U.S. PATENT DOCUMENTS

| | | | |
|---|---|---|---|
| 2,444,463 | 7/1948 | Nordquist | 29/DIG. 33 |
| 3,881,437 | 5/1975 | Lovell et al. | 113/121 C |
| 3,881,630 | 5/1975 | Lovell et al. | 220/268 |

*Primary Examiner*—Michael J. Keenan

*Attorney, Agent, or Firm*—Carl E. Johnson; Richard B. Megley; Vincent A. White

[57] ABSTRACT

A new sequence of steps provides more control in the formation in sheet metal of weakening lines of the type characterized by an integral yet fractured section. Basically, the method employs, in making so-called easy-open can ends, for example:

1. peripherally forming a closure in the sheet metal;
2. coining or scoring a profile surface of the closure, not to the depth required for fracture, but to establish residuum thickness along the desired line;
3. next, overforming the closure at least in part to controllably fracture the residuum along that coined line; and
4. lastly, swaging to seal or tighten edges of the fractured section.

7 Claims, 7 Drawing Figures

METHOD OF MAKING WEAKENING LINES IN SHEET METAL

CROSS REFERENCE TO RELATED APPLICATION

An application Ser. No. 574,643, now U.S. Pat. No. 4,006,700 filed May 5, 1975, in the names of Frederick G. J. Grise et al pertains to a method of making weakening lines by simultaneously bending sheet metal to form a wall with a locality bowed in tension adjacent to a surface thereof, and longitudinally coining that surface as it is being bent to create in the residuum thickness adjacent to the opposite wall a fractured but integral section.

Another application, Ser. No. 677,798 filed Apr. 16, 1976 in the names of Frederick G. J. Grise et al relates to a machine for making easy-open can tops.

BACKGROUND OF THE INVENTION

This invention relates to a method of making a digitally disruptable weakening line in sheet metal, the line preferably to include a fractured but integral section. The invention relates more especially to a method of making an easy-opening can end closure defined at least in part by such a line.

A prior method of making can end closures having a disruptible weakening line characterized by an integral but fractured section is disclosed in U.S. Pat. No. 3,881,437. The patented method contemplates, essentially, three successive steps which may be briefly stated to involve (a) bending or forming sheet metal to provide a closure periphery having a wall arcuate in transverse section, (b) shear-coining the wall longitudinally to create an integral but fractured section, and then (c) swaging the metal to seal or tighten the edges at the fractured section. This approach is considered to have considerable merit over the numerous and usually more complex methods previously known for making other types of weakening lines for comparable purposes. It was also recognized, as indicated in the copending application above cited that, especially when closures were to be provided in tougher metal, advantages could be attained over the patented method if steps (a) and (b) were effected substantially simultaneously rather than in sequence.

SUMMARY OF THE INVENTION

It will be appreciated that in working with sheet metals having difficult fracture properties, for instance hard temper metals, optimum residual thickness and controlled fracture to the precise degree which may be desired or required for a weakening line are not necessarily compatible. In view of the foregoing, it is an object of the present invention to provide a further improved method of making a fractured but integral (i.e. no complete severance) type weakening line whereby fairly exact control of the fracture is facilitated and satisfactory residual thickness is also attained.

Another object of the invention is to provide a method whereby, in the making of a digitally openable sheet metal closure defined by a fractured but integral weakening line, better control of the peripheral length of the line thus formed is obtained.

Yet another object of the invention is to provide a method facilitating volume production, in containers or metal portions thereof, of a fractured - but integral weakening line of circular or non-circular configuration by the use of relatively simple tools including a localized over-forming means.

To these ends, and as herein shown, a feature of the invention resides, essentially, in modifying the above-mentioned method disclosed in U.S. Pat. No. 3,881,437 by not shear-coining to the extent of fracture in mentioned step (b), but introducing a step of predetermined over-forming between the scoring provided by the step (b) and the last step of swaging. This novel four-step procedure ensures fracture at the score and to the degree needed to enable opening of a closure by substantially uniform predetermined digital pressure.

Advantageously, inclusion of the new third step in the process permits the coining operation merely to score or reduce the metal thickness leaving a desired residuum, whereupon the over-bending tools for step three, which may be shaped or positioned as an extension or continuation of the bending tools utilized in the first bending, can create sufficient tension across the score to effect the fracture in the desired locality and to the extent desired. The design of the over-forming tool, moreover, may be such as to expand and tension the sheet metal only in selected peripheral localities of a closure and then only to the degree needed, a feature of particular importance where the closure being formed is to be non-circular.

BRIEF DESCRIPTION OF THE DRAWINGS

The foregoing and other features of the invention will now be more fully described in connection with an illustrative embodiment, the process being directed to the making of digitally openable can closures, and with reference to the accompanying drawings including step views, in which.

DESCRIPTION OF THE PREFERRED EMBODIMENT

Figure 1:
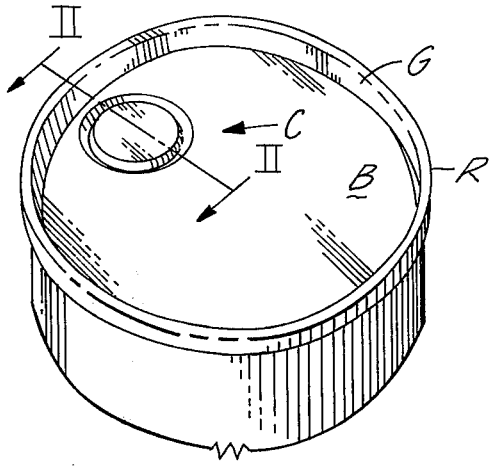
FIG. 1 is a perspective view of a representative digitally openable can end as made by the sequential steps to be explained.

Having provided a sheet metal can cover or end blank B of appropriate size and general shape desired, and perhaps including a rounded peripheral rim R with adjacent outer groove G, a novel method of providing in the blank a digitally openable closure C (FIG. 1) will be described. For purposes of clarity and simplicity in drawing, it will be understood that the closure C, herein shown as circular by way of example, may be of configuration when desired. This approach may likewise facilitate comparison with the dislosures of the U.S. Pat. No. 3,881,437 and the U.S. Pat. No. 4,006,700 above cited wherein the objective likewise was to produce a digitally openable container the closure of which is characterized by an integral but fractured section.

By appropriate means not herein shown the blank B is first positioned between upper and lower relatively reciprocable forming dies and die holders 10, 12 (FIGS. 2, 3) respectively, which are coaxially cooperative. In this initial step, essentially as hitherto taught, a female forming tool 14 relatively coaxially reciprocable in the upper die 10 has an annular, convexly rounded forming projection 16 extending downwardly to be received in annular recess 18 provided by a lower male forming tool 20 coaxiallly reciprocable in its lower forming die 12. The arrangement is such that a annular trough, channel or recess 22 (FIG. 3) is formed in the upper surface of the blank to define peripherally a domed closure portion C over a rounded head portion 24 of the male tool 20.

Figure 4:
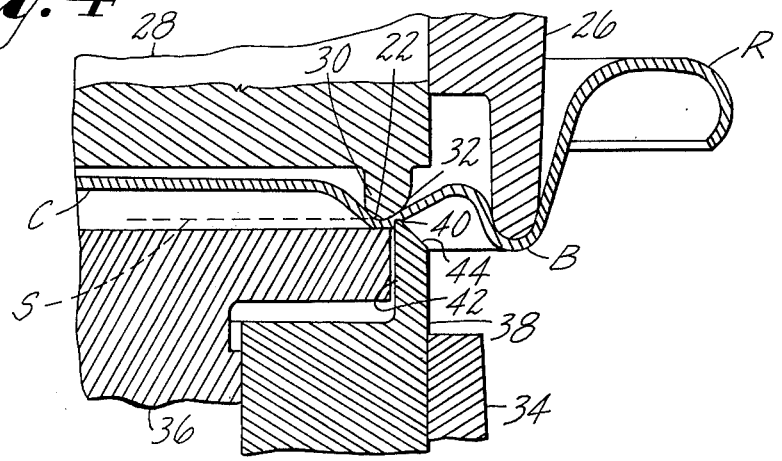
FIG. 4 is a portion of a diametric, enlarged section showing the closure periphery next undergoing a second or scoring step involving shear-coining, but not to the extent of sheet fracture.
Figure 6:
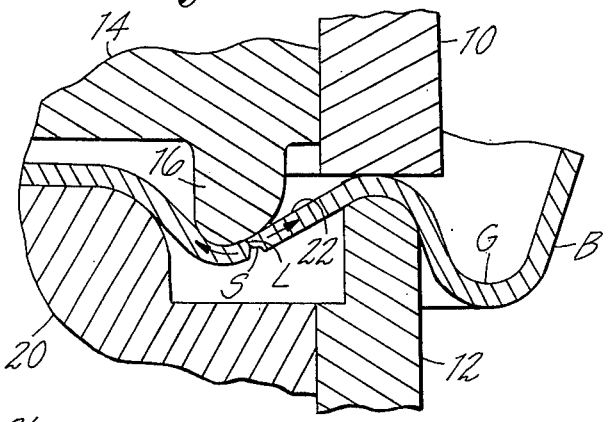
FIG. 6 is a further enlargement showing the fractured but integral section resultant from the over-forming indicated in FIG. 5.

In the next or scoring stage of the method being described, the blank B is engaged in its outer groove G by the annular lower end of a holding member 26 (FIG. 4) which has telescoped therein an axially reciprocable upper forming and backing tool 28. The latter resembles the upper forming tool 14 in having an annular depending projection 30 provided with an outer, convex profile 32 arranged to nest in the recess 22. A cylindrical lower guide block 34 reciprocably houses a work support and ejector 36 and a scoring tool 38 movable heightwise between the guide 34 and the support-ejector 36. As shown in FIG. 4, the upper end of the tool 38 preferably has a flatted, narrow annular coining face 40 for penetrating the sheet metal to provide a score S corresponding to the desired configuration of a weakening line (FIG. 6). The face 40 is herein shown as extending horizontally between a vertical inner face 42 and a bevelled outer face 44. The high point of the face 40 during scoring will customarily be at substantially the same level as the ridge tip or summit of the projection 30 but to one side of the ridge; by means not herein shown, however, their relative vertical operating heights preferably may be adjusted. In contrast to the disclosure of the U.S. Pat. No. 3,881,437, it is noted that the present invention contemplates that penetration in the blank B by the coining face 40, though desirably accompanied by a shear effect because operating against the convex surface 32, is to establish an optimum residual thickness but without incurring fracture in the metal.

Figure 2:
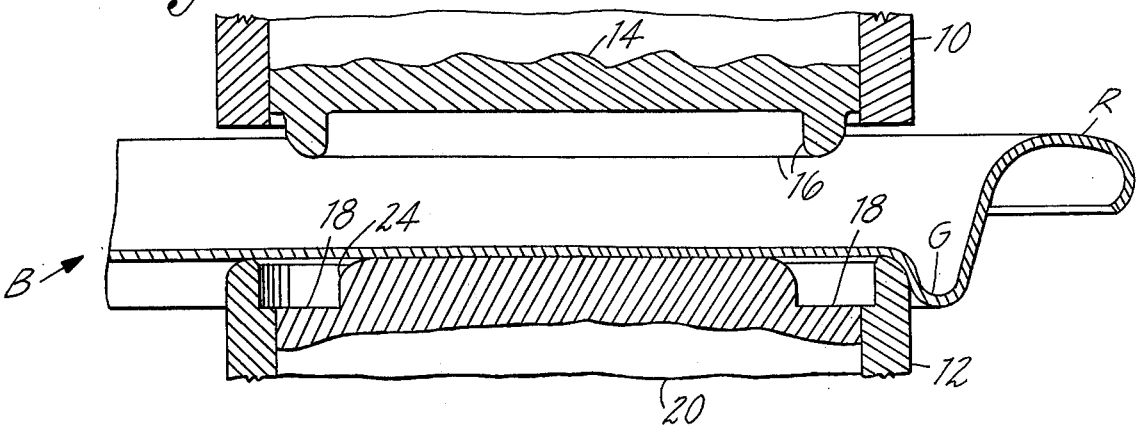
FIG. 2 is a diametric section, taken on the line II—II of FIG. 1 and on an enlarged scale, showing upper and lower forming dies and their respective female and male closure forming tools in initial spaced or inoperative positions preparatory to forming a can end closure substantially as in FIG. 1.
Figure 3:
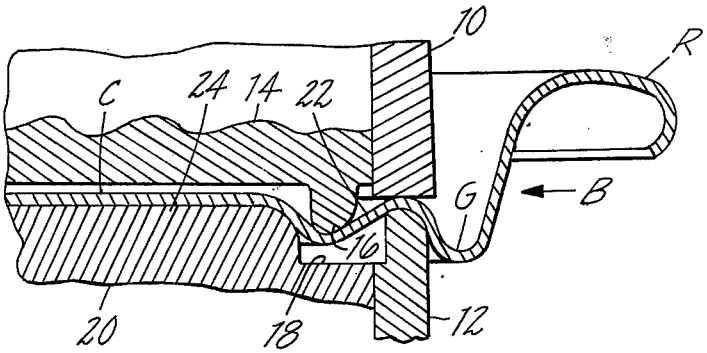
FIG. 3 is a section similar to FIG. 2 but showing the parts in cooperative initial forming position.
Figure 5:
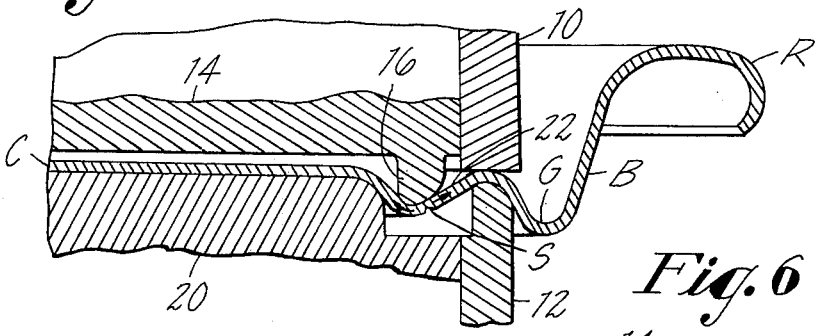
FIG. 5 is a section similar to that of FIGS. 3 and 4 and now illustrating (by exaggeration) a third or over-forming step inducing controlled fracture along the score line.

Referring to FIG. 5, next comes the important third step which employs implements identical to or quite similar to those shown for initial forming in FIGS. 2 and 3. For simplicity the same reference characters are applied in FIGS. 2, 3 and 5. The function performed in this third step is to over-form, i.e. further bend the blank so as to slightly deepen the channel 22 and thereby tension the metal transversely of the score line S provided by the second step (as indicated by the arrows in FIG. 5) to produce an integral yet fractured section L (FIG. 6) in the residuum. For this purpose the upper closure forming tool may have its projection 16 shaped substantially to correspond with the convex profile 32 indicated in FIG. 4 and be moved to a slightly lower relative operating position, or alternatively the projection 16 may have a modified or special shape (not shown) the surface of which desirably has a radius of curvature less than that of the channel wall surface engaged thereby and need not necessarily be given a closer movement of approach to the tool 20 to effect the desired degree of transverse tension across the scoring and the concomitant fractured but integral section in the residuum. This novel step of thus "fracturing the score" by tensioning the formed and scored sheet metal over a transversely arcuate surface insures not only that the desired degree of fracture (appropriate to subsequent uniform digital disrupting) will be produced, but that the integral fracture will be incurred exactly where it is linearly wanted. Moreoever, the over-forming tool 14 can be designed to expand and tension the metal only at those peripheral localities where the fracture is needed and not at other localities. Thus the length of the arc of such fracture can be precisely limited. Also, the method being described generally permits the use of simpler tooling even when the closure is to be of some non-circular shape.

Figure 7:
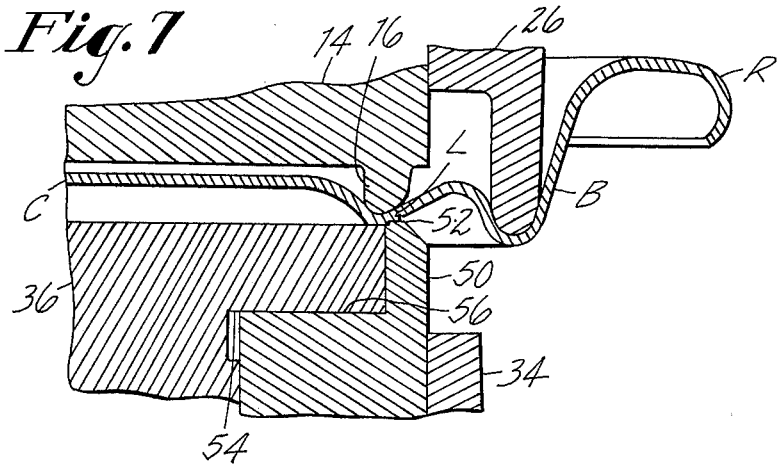
FIG. 7 is another enlarged diametric section showing the fourth or swaging step which, except for probable subsequent lacquering, essentially completes the ruptur-able can end.

A last step (FIG. 7) involves swaging the metal adjacent to the fractured but integral weakening line L to close or tighten its irregular edges. This step in itself is not new since it is essentially disclosed in the method of the cited U.S. Pat. No. 3,881,437. As shown in FIG. 7 the upper female closure forming tool 14 and the holding member 26 may engage the upper side of the formed can end, and the under side is engaged by a member such as the work support-ejector 36 within the cylindrical guide block 34, and a swaging tool 50 telescoped for heightwise movement in the guide block. The upper end of the tool 50 is formed with an annular, flatted face 52 arranged to cooperate with the transversely convex surface of the projection 16 at the outer side of its lower extremity. Accordingly, the relatively upward swaging blow of the face 52 directed to the radially inner edge of the fractured but integral section effects a localized metal flow and peripheral dilation tending to close and seal the fracture along the line L. Limitation of the relative upward movement of the face 52 may be effected by engagement of shoulders 54, 56 and/or other adjustable stop means not herein illustrated. It will be understood that, although not herein shown, a lacquering of either or both sides of the can end or cover may follow separation of the swaging tools to release the work.

Briefly, to review my novel method of making digitally openable sheet metal closures, the steps of the sequence are now restated. First, a closure forming is performed on the blank B by dies cooperating in conventional manner (FIG. 3) to produce the desired circular or other closure configuration C. Abutments or other known stops (not shown) are usually provided to suitably limit this initial bending-forming operation, and upon separation of the tools the formed blank B is introduced into the scoring means (FIG. 4) while they are relatively retracted. Upon relative movement together of the tool 28 and the scoring tool 38, the face 40 reduces the thickness of the blank B along a peripheral score line. This produces a residuum which may be of uniform or tapering dimension, but at no locality therealong does the scoring effect a fracture in the residuum which extends either completely through to cause severance or which remains an integral section.

At the next or over-forming stage illustrated in FIGS. 5 and 6. It will be understood suitable adjustable stop means (not shown) is provided for limiting relative movement of approach of the dies and tools. This critical third step is relied upon to tension the metal of the residuum, transversely of the scoring S, to the degree found desirable for effecting a suitably fractured but integral section L. It is important that control of the degree, length, and precise location of such fracture be carefully exercised since uniformly repeatable resistance to digital closure opening is essential in the finished container; such control is aided by both the prior scoring and the transverse over-bending of the metal along the score and over the transversely convex profile. It will further be appreciated that localized over-forming and the extent thereof is attainable with suitable tooling and accordingly this method will facilitate the making of closures of shapes other than circular. The length of arc of an integral fracture in a closure periphery can be obtained by designing the over-forming tool 16 to expand and tension the metal only where needed, and as appropriate for a particular metal temper.

The last step in the process, as shown in FIG. 7, involves swaging. It is performed by the face 52 along an edge of the fractured but integral section L and preferably against the transversely arcuate backing surface. It will be appreciated that, as in prior steps described, the can end is exactly positioned in registry with the tooling. Impact of the face 52 against the arcuately backed edge of the metal forces it to flow radially outward and into overlapping or sealing relation with confronting mating edges of the fractured section. The consequent enlargement and locking of the periphery of the closure C, though not large dimensionally, insures that digital inward pressure thereon can reliably open the closure when the can has become a portion of a container, and that contents of the container will not because of internal or other pressure be leaked prior thereto at the closure periphery.

From the foregoing it will be understood that the present method in several important aspects provides certain advantages in manufacture over the method of the mentioned Grise and Lovell patent.

I claim:

1. The method of making a digitally disruptable closure in a sheet metal blank comprising, in sequence:

a. bending a portion of the blank out of its plane to provide a closure-defining peripheral wall in the blank, b. coining the wall periphery lengthwise to score and establish a non-fractured residuum thickness, c. transversely bending said wall to tension the metal across the residuum thickness until a fractured section characterized by irregular fissures and matching edges is produced therein, and then d. swaging at least one of the edges of said fractured section to lock the closure disruptably to the remainder of the blank.

2. The method of claim 1 wherein step (c) consists in effecting the tensioning of said fractured section by engaging said wall with an over-forming die.

3. The method of claim 1 wherein, in step (d) the swaging enlarges the periphery of the closure to seal or lock its fractural edge to the remainder of the blank.

4. The method of claim 3 wherein the over-forming die has a transversely convex working surface engageable with the wall along its scoring, and step (c) includes reciprocating the die surface into and out of blank flexing relation with an unbacked portion of said wall.

5. The method of making a weakening line in sheet metal, which line is to be digitally disruptable, comprising depressing the metal out of its general plane to provide a channel having parallel opposed wall surfaces, said surfaces being arcuate in cross section, scoring one of said surfaces longitudinally to provide a predetermined residuum thickness in the wall extending in the desired path of the weakening line, flexing the sheet metal over a transversely convex forming tool surface disposed adjacent to the opposite one of said channel wall surfaces to induce fracture without separation in said residuum thickness, and swaging the metal of said one surface along said scoring to urge the metal to flow into closed or overlapping relation with the fracture.

6. The method of claim 5 wherein said forming surface has a radius of curvature less than that of the channel wall surface engaged thereby as the latter is initially shaped, and said forming surface engages the scored locality of the wall surface to exert sufficient tension across the score line to produce the fracture in said residuum while not effecting severance thereat.

7. The method of claim 6 wherein said flexing is effected over said forming tool surface and the resultant fracture is induced to a different extent in different localities and not at all in other localities by reason of contour changes in the forming tool surface, which changes are designed to differently tension and expand the closure periphery in the localities selected.

* * * * *